US006489891B1

(12) United States Patent
Ho et al.

(10) Patent No.: US 6,489,891 B1
(45) Date of Patent: Dec. 3, 2002

(54) APPARATUS FOR ELECTRONIC ARTICLE SURVEILLANCE TAG POLLUTION REDUCTION

(75) Inventors: Wing Ho, Boynton Beach, FL (US); Eugenio Morgado, Boca Raton, FL (US); Larry Speciale, Loxahatchee, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/859,186

(22) Filed: May 16, 2001

(51) Int. Cl.[7] ..... G08B 13/14
(52) U.S. Cl. ..... 340/572.3; 340/572.6
(58) Field of Search ..... 340/572.3, 572.1, 340/572.6, 572.8, 572.9

(56) References Cited

U.S. PATENT DOCUMENTS 4,510,489 A 4/1985 Anderson et al. ..... 340/572.1
4,797,658 A * 1/1989 Humphrey ..... 340/551
5,012,225 A 4/1991 Gill ..... 340/572.3
5,574,431 A 11/1996 McKeown et al. ..... 340/572.3
5,689,263 A * 11/1997 Dames ..... 342/51
5,729,200 A 3/1998 Copeland et al. ..... 340/551
6,091,607 A * 7/2000 McKeown et al. ..... 361/777

* cited by examiner

*Primary Examiner*—Benjamin C. Lee
(74) *Attorney, Agent, or Firm*—Rick F. Comoglio

(57) ABSTRACT

A magnetomechanical EAS tag having a bias magnet made of a high magnetostrictive material so that stress, which is a result of ordinary use of an article incorporating the tag, demagnetizes the bias rending the EAS tag inactive is provided. In an alternate embodiment a mechanical mechanism is incorporated with a conventional EAS tag to deactivate the tag upon ordinary use of an article to which the tag is associated. In yet another embodiment, a combination of the bias magnet made of a high magnetostrictive material and a mechanical deactivation mechanism is used to deactivate an EAS tag during ordinary use of an article to which the tag is associated.

12 Claims, 6 Drawing Sheets

APPARATUS FOR ELECTRONIC ARTICLE SURVEILLANCE TAG POLLUTION REDUCTION

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to deactivatable magnetomechanical markers and labels for electronic article surveillance (EAS) systems, and more particularly to using a mechanical mechanism and a high magnetostrictive material as a deactivatable bias to reduce tag pollution due to magnetomechanical EAS markers.

2. Description of the Related Art

EAS systems are typically used to prevent unauthorized removal of items from a designated area. In a retail environment, EAS labels are attached to articles for sale, and when active, will trigger an alarm if carried through interrogation zones typically located at the store exits. After an authorized sale of an article, store personnel deactivate the attached EAS label so the article can be removed from the store without triggering the EAS system. As used herein, the terms "markers", "labels", and "tags" are used interchangeably and refer to markers, labels, tags, and the like, used to trigger EAS systems.

Presently, many items of merchandise are source tagged. Source tagging is the attachment of EAS labels at the manufacturing or distribution site. Source tagging can result in an increase in a problem known as "tag pollution". Tag pollution refers to active or partially active labels inadvertently being carried into EAS equipped stores triggering the EAS alarm. When articles are source tagged with EAS labels, some of the tagged merchandise may be shipped to stores that are not equipped with EAS systems. With no EAS system in the store, when these tagged products are legitimately sold the EAS labels are not deactivated. The active EAS labels can trigger EAS alarms when the customer carries or wears an article, having an active label attached, into a store equipped with an EAS system.

Solutions to the tag pollution problem include providing security personnel at the store entrance to appropriately handle inadvertent EAS alarms. For example, EAS labels that alarm the system can be deactivated at the door. This solution can increase personnel costs and inconvenience to the customers. Alternately, the problem can be handled at the distribution point by properly deactivating EAS labels that are attached to products intended for stores without the appropriate EAS equipment. However, this can increase the time and costs associated with distribution. As more and more articles are source tagged with EAS labels, tag pollution will be an increasing problem.

U.S. Pat. No. 5,574,431 (the '431 patent) discloses a security tag that is deactivatable as a result of stress induced by ordinary use of the article. The '431 patent is directed to radio frequency (RF) tags, which work in RF EAS systems. RF EAS systems transmit and respond to RF energy in the interrogation zone. RF tags are comprised of a resonant circuit that detectably responds to the RF energy transmitted into the interrogation zone. The '431 patent is directed to a mechanical stress concentrator that breaks the resonant circuit at a stress concentration point due to the stress caused by ordinary use of the article. The resonant circuit is opened and becomes disabled preventing the circuit from resonating when exposed to the interrogating RF energy. Thus, normal wearing of RF EAS tagged articles deactivates the attached RF EAS tags reducing the tag pollution problem.

Magnetomechanical EAS markers do not contain resonant circuits in an analogous manner to RF tags. A magnetomechanical EAS marker is made of an elongated strip of magnetostrictive ferromagnetic material, the "resonator", disposed adjacent a hard ferromagnetic element that, when magnetized, magnetically biases the strip and arms it to resonate mechanically at a preselected magnetic resonant frequency. The resonator is captured within a cavity in the marker housing so that it is free to mechanically vibrate. The hard ferromagnetic element, or bias, is a high coercivity biasing magnet that is capable of applying a DC magnetic bias field to the resonator. The bias magnet is positioned adjacent the resonator, but not in direct contact. The marker resonates when subjected to a magnetic interrogation field at a frequency at or near the marker's resonant frequency. The response of the marker at the marker's resonant frequency can be detected by EAS receiving equipment, thus providing an electronic marker for use in magnetomechanical EAS systems. Demagnetizing the bias magnet deactivates the marker. U.S. Pat. No. 4,510,489 discloses further information about magnetomechanical EAS systems.

U.S. Pat. No. 5,729,200, (the '200 patent) the disclosure of which is incorporated herein by reference, discloses that conventional magnetomechanical EAS markers use amorphous metal alloys such as Metglas 2628CoA, having a composition of $Fe_{32}Co_{18}Ni_{32}B_{13}Si_5$, and Metglas 2826MB, both available from Honeywell AlliedSignal, Inc. Parsippany, N.J., and VC4613 available from Vacuumschmelze GmbH, Grüner Weg 37, D-63450, Hanau, Germany, and other similar alloys for the active resonator. The bais magnet can be formed from a semi-hard magnetic material, such as SemiVac 90 available from Vacuumschmelze, Hanau, Germany, having a coercivity of around 70 to 80 Oersteds (Oe), and which requires an AC deactivation magnetic field of about 200 Oe. Alternately, a low coercivity material, such as SensorVac, also available from Vacuumschmelze, having a coercivity of about 20 Oe, can be used for the bias magnet, which requires a lower deactivation field that is useful for source tagged articles as described in the '200 patent. A characteristic of all conventional bias magnet materials is that they are selected to have low magnetostriction so that stress induced by normal handling of the markers, and the articles to which the markers are attached, does not cause deactivation.

A method of deactivating a magnetomechanical EAS marker attached or contained within an article by stress induced by ordinary use of the article is needed.

BRIEF SUMMARY OF THE INVENTION

A first aspect of the present invention is a deactivatable magnetomechanical electronic article surveillance marker with a magnetostrictive resonator adapted to mechanically resonate at a frequency within a preselected detection frequency range provided by an incident magnetic field. A magnetizable bias magnet is disposed adjacent the resonator that, when magnetized, biases the resonator with a magnetic field having a predetermined field strength to arm the resonator to resonate at the frequency. The bias magnet is magnetostrictive and demagnetizable by stress, such that normal use of an article incorporating the marker deactivates the marker. The marker can be incorporated into the article during manufacturing, or subsequent to manufacturing of the article.

The bias magnet can be made of an alloy composition containing a saturation magnetostriction of about 25 to about 50 parts per million (ppm). In one embodiment, the bias magnet is made of an alloy composition containing a saturation magnetostriction of about 50 ppm.

A second aspect of the present invention is a deactivatable magnetomechanical electronic article surveillance marker having a marker housing attachable to an article, a magnetostrictive resonator adapted to mechanically resonate at a frequency within a preselected detection frequency range provided by an incident magnetic field is disposed within the marker housing. A magnetizable bias magnet is disposed adjacent said resonator that, when magnetized, biases said resonator with a magnetic field having a predetermined field strength to arm the resonator to resonate at the frequency. A mechanism as described herein is disposed adjacent the marker housing for compressing the marker housing during ordinary usage of the article to dampen the mechanical resonance of the magnetostrictive resonator.

A mechanical deactivator can be attached to the marker housing and has a moveable member with a free end terminating in a pointed protrusion. The moveable member is adapted to move towards the marker housing forcing the pointed protrusion into the marker housing during ordinary usage of the article to dampen the resonance of the magnetostrictive resonator.

The bias magnet can be magnetostrictive and demagnetizable by stress, wherein normal use of the article incorporating the marker deactivates the marker, so that the marker includes both modes of deactivation.

Objectives, advantages, and applications of the present invention will be made apparent by the following detailed description of embodiments of the invention.

DETAILED DESCRIPTION OF THE INVENTION

Figure 1:
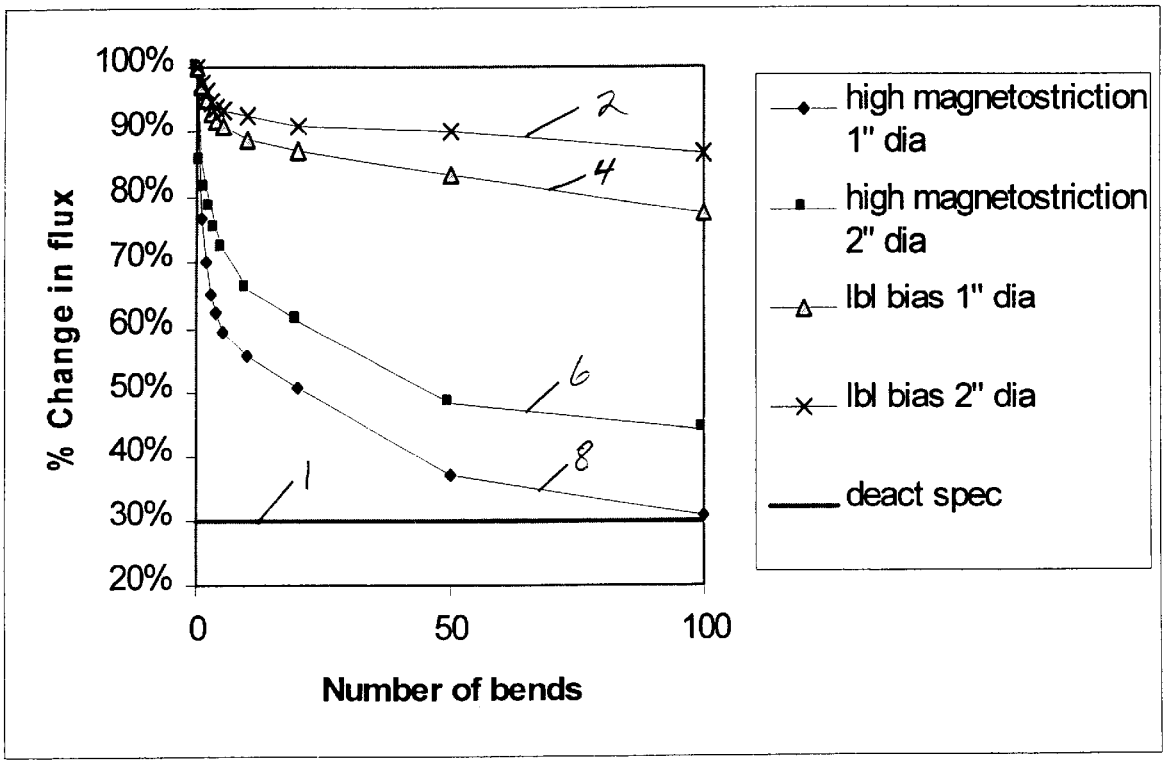
FIG. 1 is a plot showing the effect on magnetic flux as a result of bending various bias magnet compositions.

Referring to FIG. 1, the number of bends versus the percent change in magnetic flux from 100% of the maximum bias level to the deactivation specification 1 of 30% of maximum is illustrated for various bias magnet compositions. The maximum magnetic bias level depends on the particular bias material selected. For example, for resonators made of VC4613, the 100% magnetic bias level is preferably in the range of about 5.85 to 7.15 Oe. The '200 patent discloses magnetic properties of various conventional bias materials. The required bias level range is dependent upon the resonator material selected. Curve 2 and curve 4 show the change in magnetic flux for a conventional bias magnet material, such as the SensorVac material described hereinabove, for a 2 inch and a 1 inch bend diameter, respectively. Curve 6 and curve 8 show the change in magnetic flux for a material that is similar to the SensorVac material but which has high magnetostrictive properties. High magnetostrictive properties is defined by an alloy composition containing a saturation magnetostriction of about 25 to about 50 parts per million (ppm). Saturation magnetostriction is the amount of elongation a material exhibits from its demagnetized state to fully magnetized state along the magnetization direction. The elongation is expressed, in parts per million, as the ratio of the change in length upon magnetization to the length of the material in the demagnetized state. The effect the invention makes use of is the inverse magnetostrictive effect, where mechanical stress affects the magnetization of the material. The higher the saturation magnetostriction, the stronger the inverse effect, and the larger demagnetization of material possible given the same amount of stress applied to the material. In the example, the bias magnet is made of an alloy composition containing a saturation magnetostriction of about 50 ppm.

As illustrated in FIG. 1, the conventional materials maintain over 80%, or 90%, of their maximum flux strength for 100 cycles of 2 inch, and 1 inch bends, respectively. The high magnetostriction material selected in the example reaches deactivation level 1 at 100 cycles of bending at a 1 inch diameter. The final design and the appropriate magnetostriction of the bias material depends on the required stability of the active label, the bending diameter imparted on the bias in the application, and the targeted number of cycles of bending before the label is failed.

Figure 2:
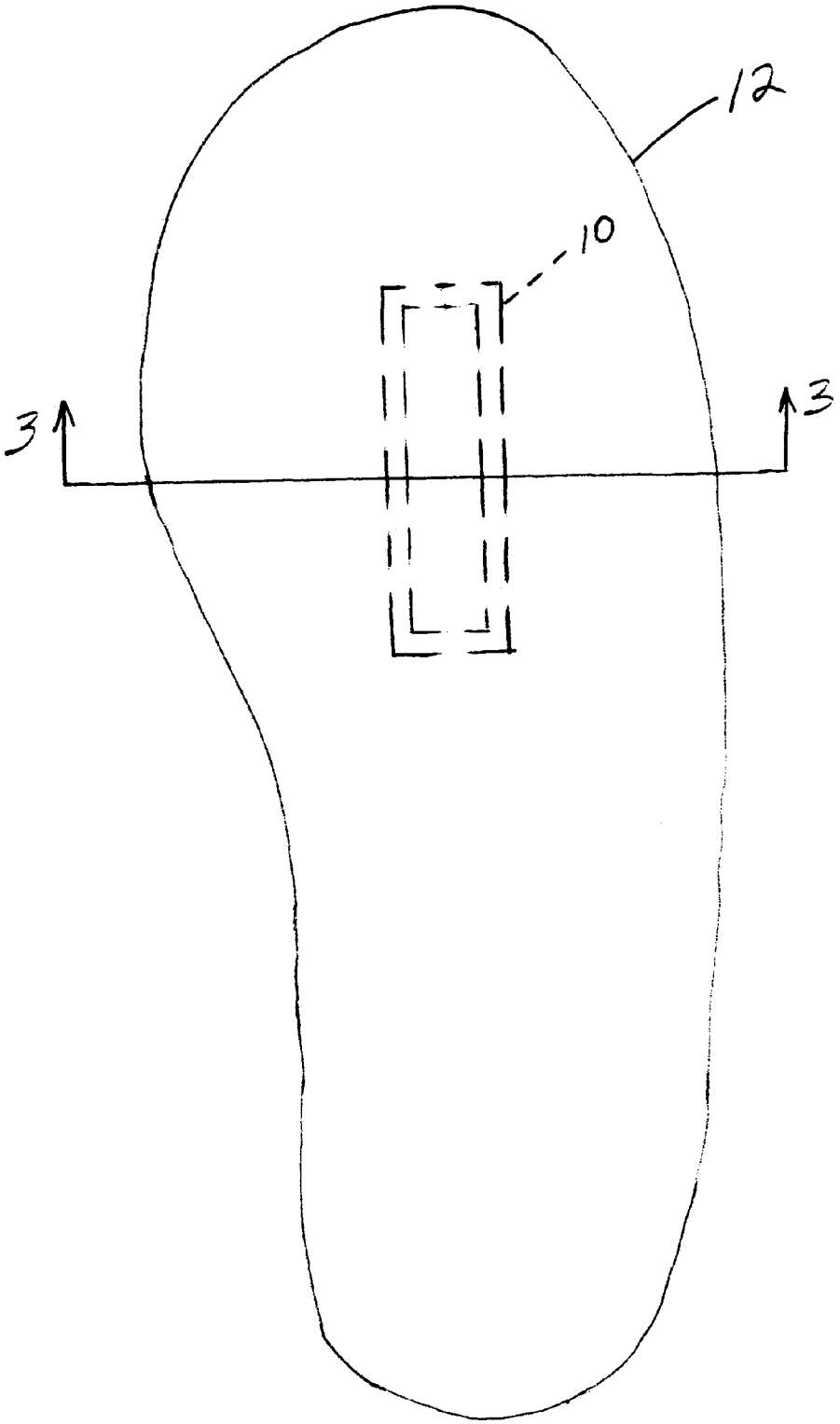
FIG. 2 is a bottom plan view of one embodiment of the present invention.

Referring to FIG. 2, one embodiment of the invention is illustrated showing EAS label 10 disposed in an article of merchandise, which in this example is shoe 12. The exact position of label 10 will be determined according to the article to which it is to be incorporated, and the anticipated bending diameter or stress placed upon the bias during normal use of the article. FIG. 2 illustrates an example of a possible placement of label 10 for shoe 12.

Figure 3:
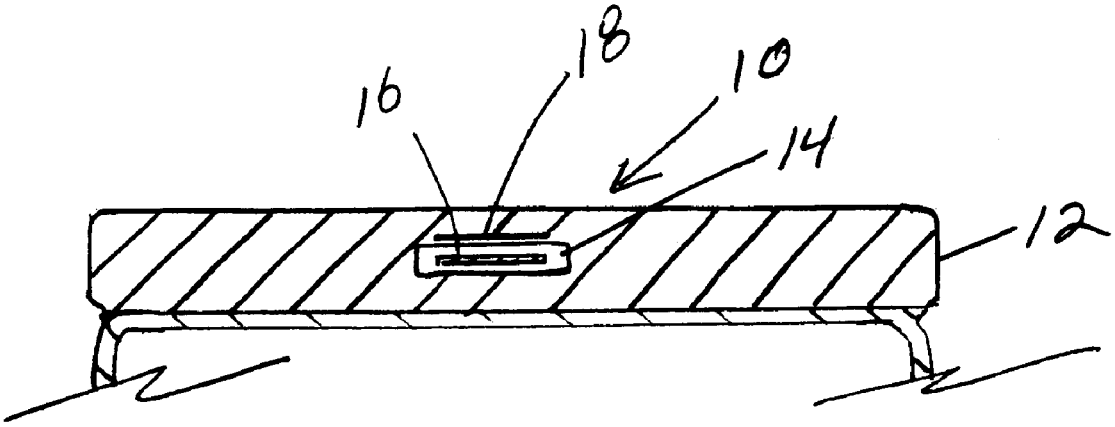
FIG. 3 is an rear elevational view, in cross-section, taken along line 3—3 in FIG. 2.

Referring to FIG. 3, label 10 includes resonator cavity 14, with resonator 16 disposed therein. Bias magnet 18 is disposed adjacent resonator cavity 14 in a suitable position to permit bending or other mechanical stress to be imparted onto the bias during normal use of the article, in this case bias magnet 18 is bent when a user walks or runs wearing shoe 12.

Figure 4:
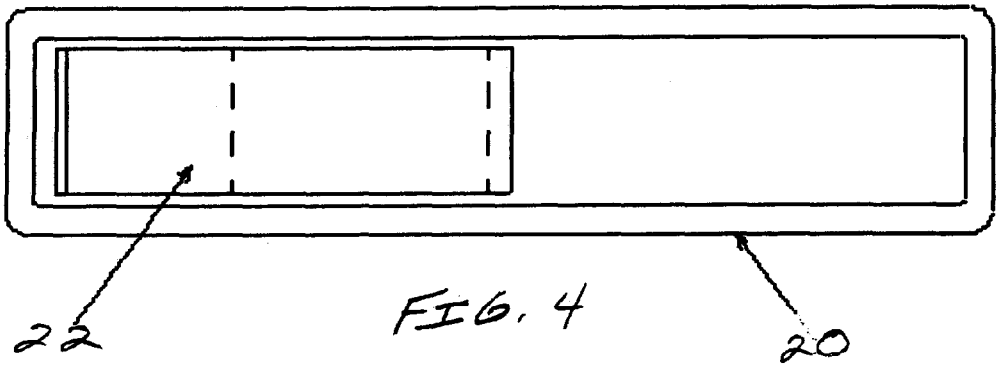
FIG. 4 is a top plan view an alternate view of the present invention.
Figure 5:
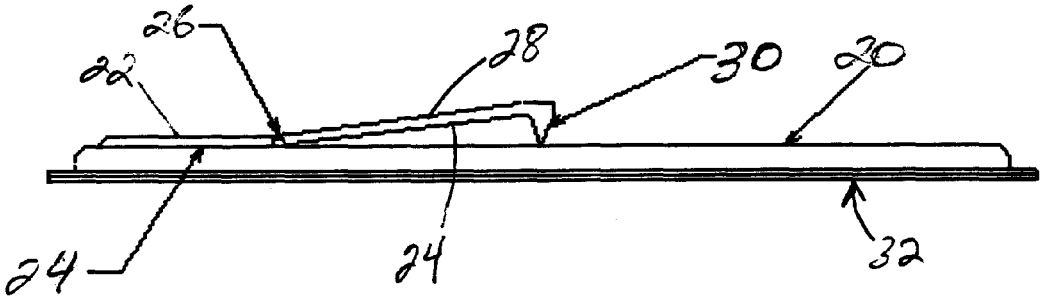
FIG. 5 is a front elevational view of that of FIG. 4.
Figure 6:
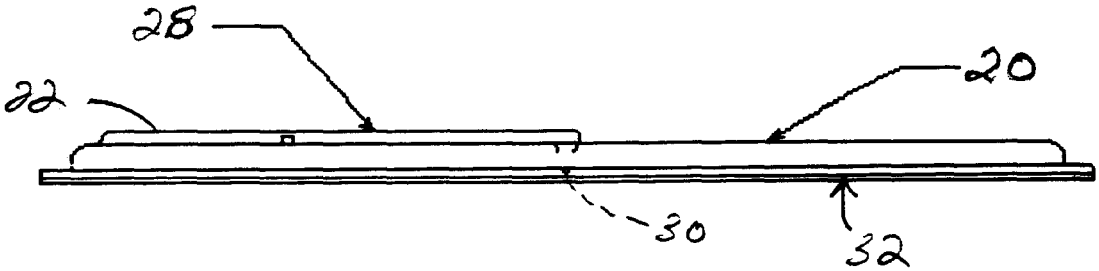
FIG. 6 is a front elevational view of that of FIG. 5 after deactivation.

Referring to FIGS. 4 and 5, a magnetomechanical EAS label 20 is illustrated with a mechanical deactivator 22 attached. Magnetomechanical EAS label 20 is understood to include a marker housing having an internal cavity with a resonator disposed therein and an adjacent bias magnet. Deactivator 22 can be attached to EAS label 20 by any suitable manner such as pressure sensitive adhesive 24. Deactivator 22 includes a hinge 26 and a movable member 28 with the free end terminating in a pointed protrusion 30. When EAS label 20 is attached to an article by an adhesive layer 32, under normal usage of the article, member 28 bends at hinge 26 and moves toward EAS label 20. Once member 28 makes contact with label 20, pressure sensitive adhesive 24 retains member 28 against label 20 to maintain contact of pointed protrusion 30 onto label 20. With repeated use of the article, pointed protrusion 30 is forced into EAS label 20, deforming the label housing and eventually breaking or dampening the magnetomechanical resonator contained therein. Pointed protrusion 30 may actually break the resonator or bias magnet disposed within the label housing, or it may merely crush or compress the housing into the resonator and bias. The main object is to prevent free vibration of the resonator at the resonance frequency of the label. As the resonator becomes pinched in the housing due to pointed protrusion 30 being forced into the label housing, the frequency of vibration changes and the amplitude at the marker's resonant frequency drops. Once the magnetomechanical resonator is dampened by pointed protrusion 30, EAS label 20 is considered deactivated and will not be detected in a magnetomechanical EAS system. EAS label 20 can contain a high magnetostrictive bias, as fully described hereinabove, in additional to mechanical deactivator 22, so that during normal usage of an attached article, the EAS label will include two modes of deactivation.

In alternate embodiments of the present invention, deactivator 22 may not be separate from label 20 as label 20 can be manufactured to include a member that includes an equivalent of pointed protrusion 30 to deactivate the label upon repeated mechanical stress. Pointed protrusion 30 could take the form of a ridge formed on or within label 20.

Figure 7:
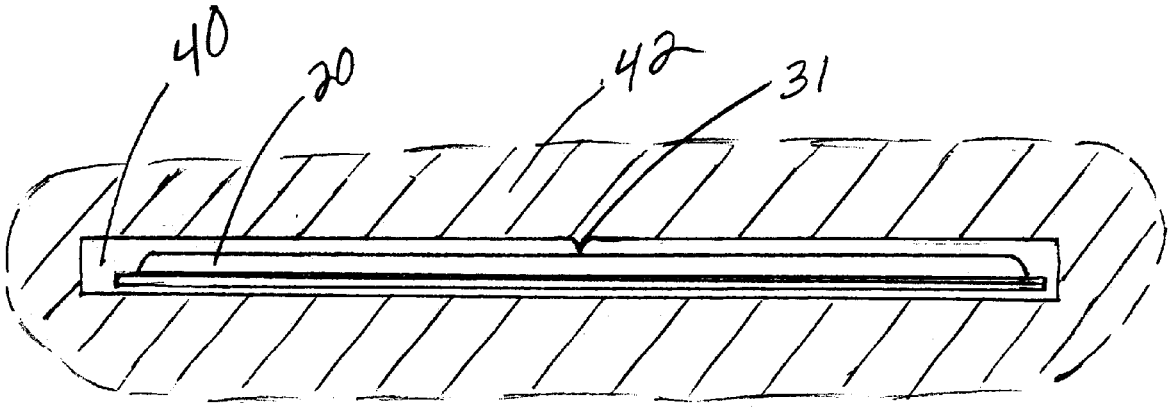
FIG. 7 is an alternate embodiment of that shown in FIG. 5.

Referring to FIG. 7, label 20 may be placed in a cavity 40 formed within an article 42 and not attached via adhesive 32 to the exterior of the article. Therefore, instead of being part of, or attaching to label 20, a pointed protrusion 31 could be made part of, or attached to, cavity 40 manufactured in the article 42 in which label 20 is placed.

The main function of pointed protrusion 30 and its equivalents is to dampen free vibrations of the resonator contained within label 20 to make the label 20 undetectable in an associated EAS system. Dampening the vibration of the resonator can be accomplished by crushing and/or compressing label 20. As stated hereinabove, a magnetostrictive deactivateable bias can be used within a label that includes pointed protrusion 30, or its mechanical equivalents, to incorporate two modes of deactivation.

Figure 8:
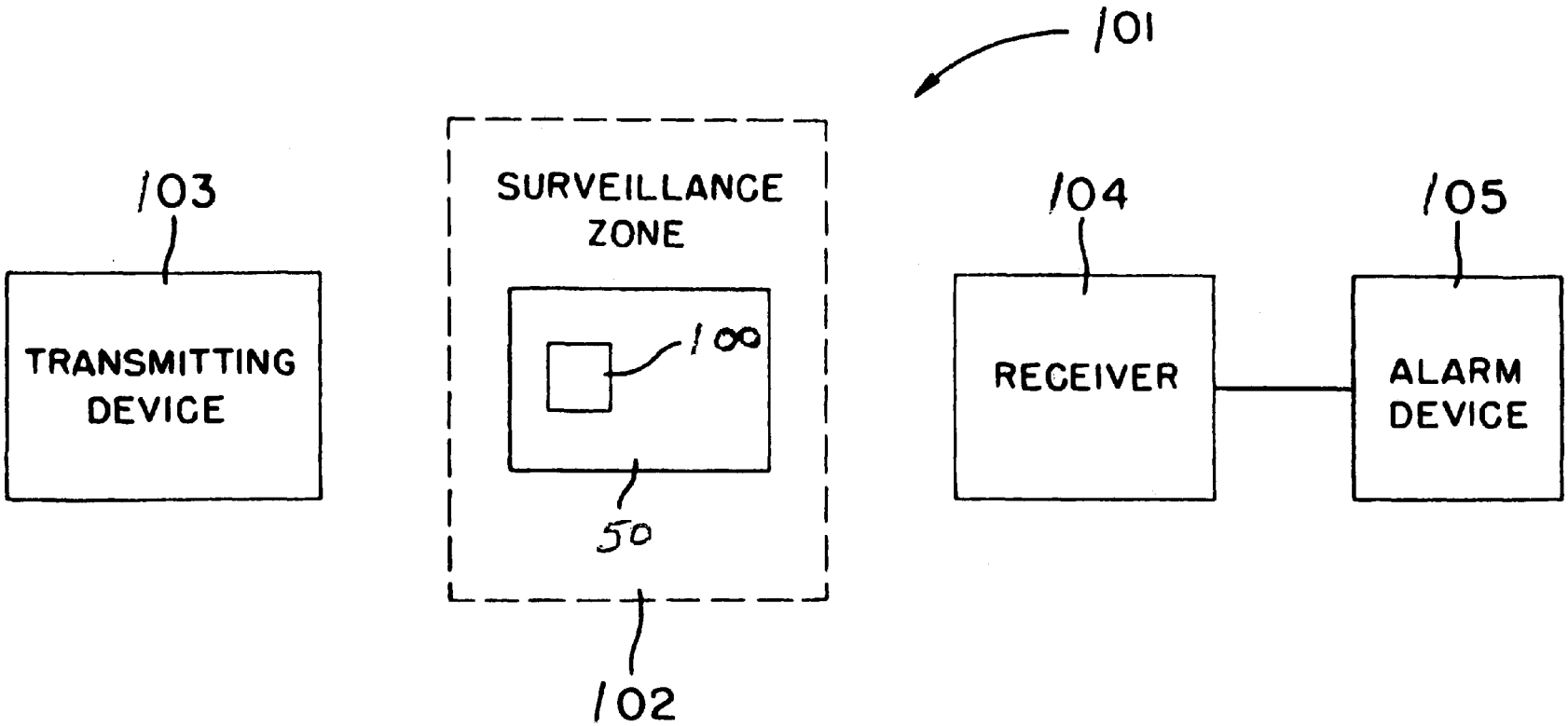
FIG. 8 is a block diagram of an electronic article surveillance system incorporating the present invention.
Figure 1:
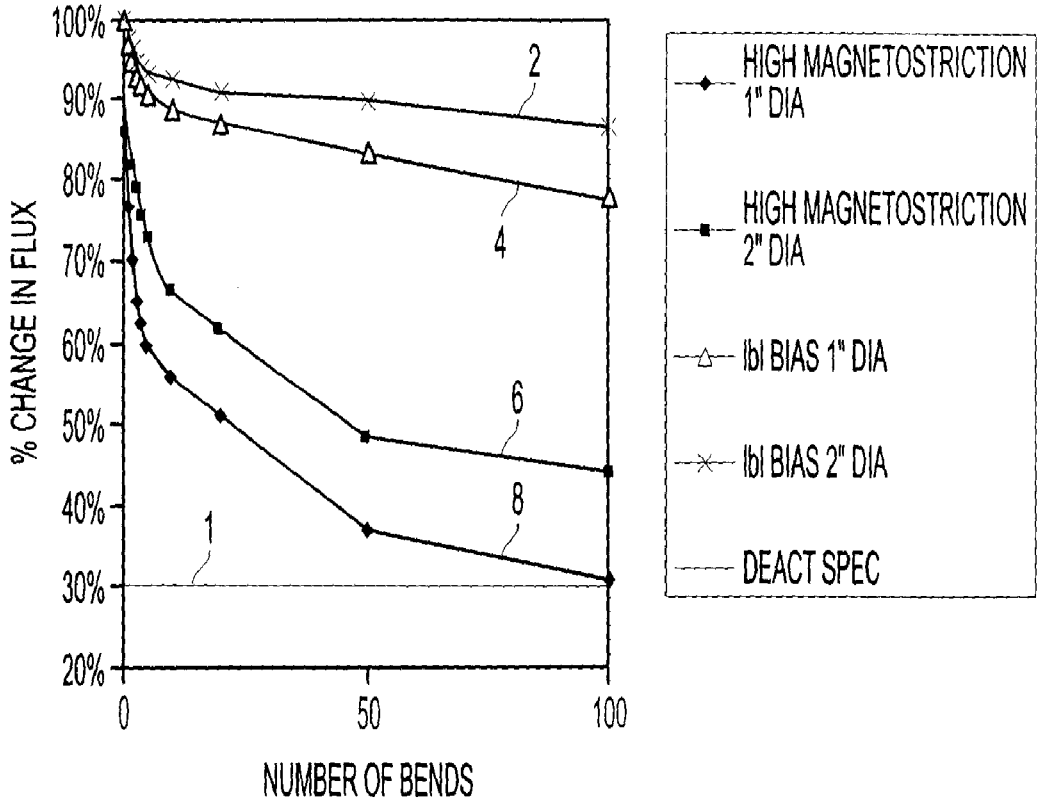
Figure 2:
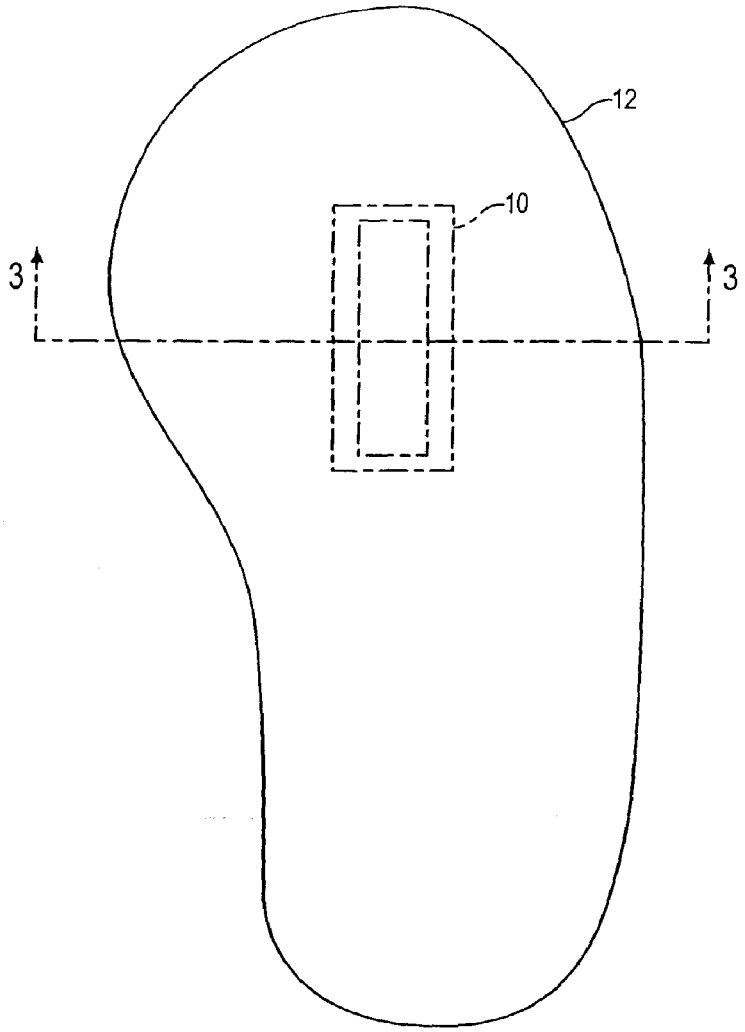
Figure 3:
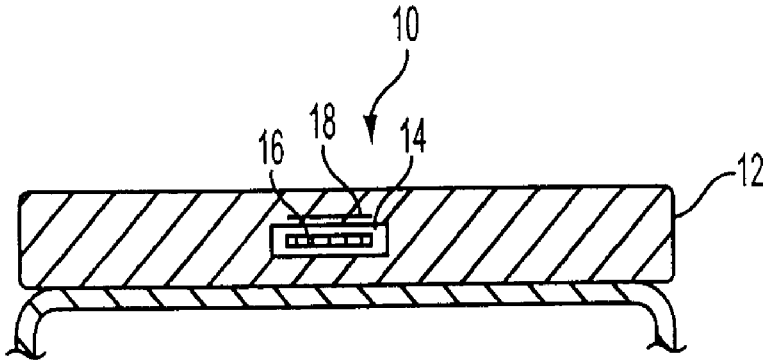
Figure 4:
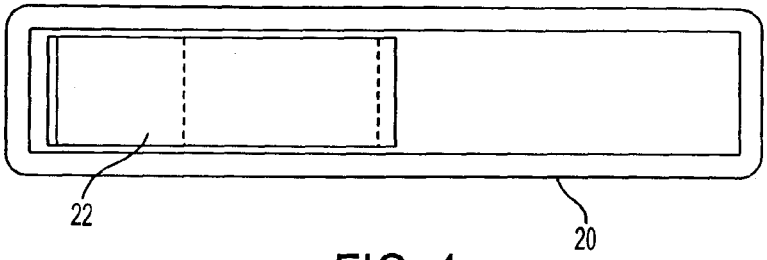
Figure 5:
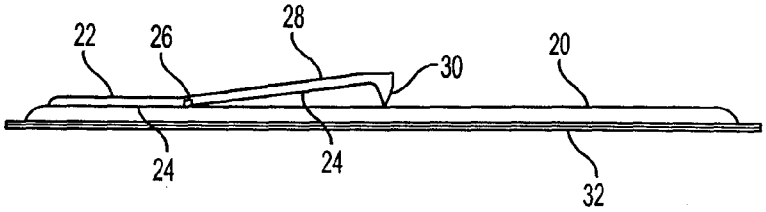
Figure 6:
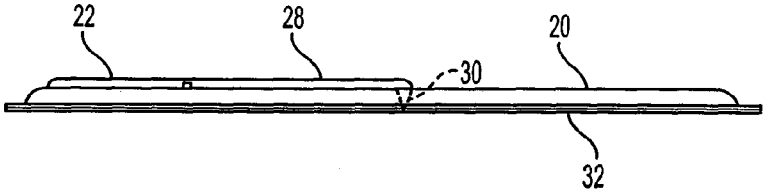
Figure 7:
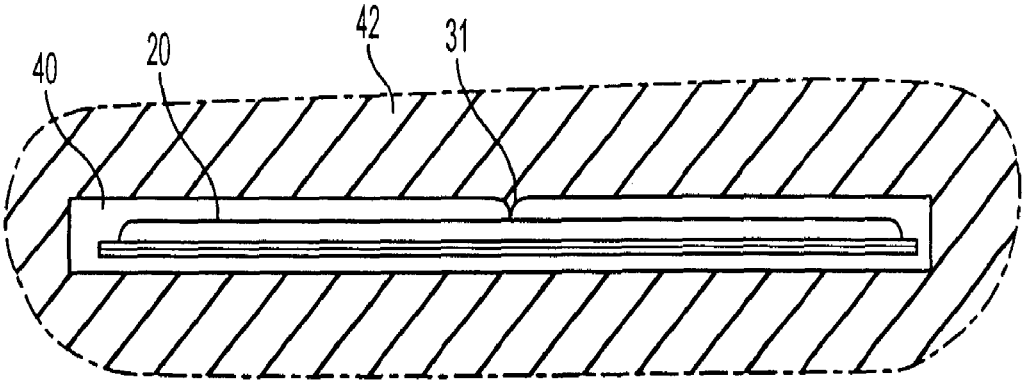
Figure 8:
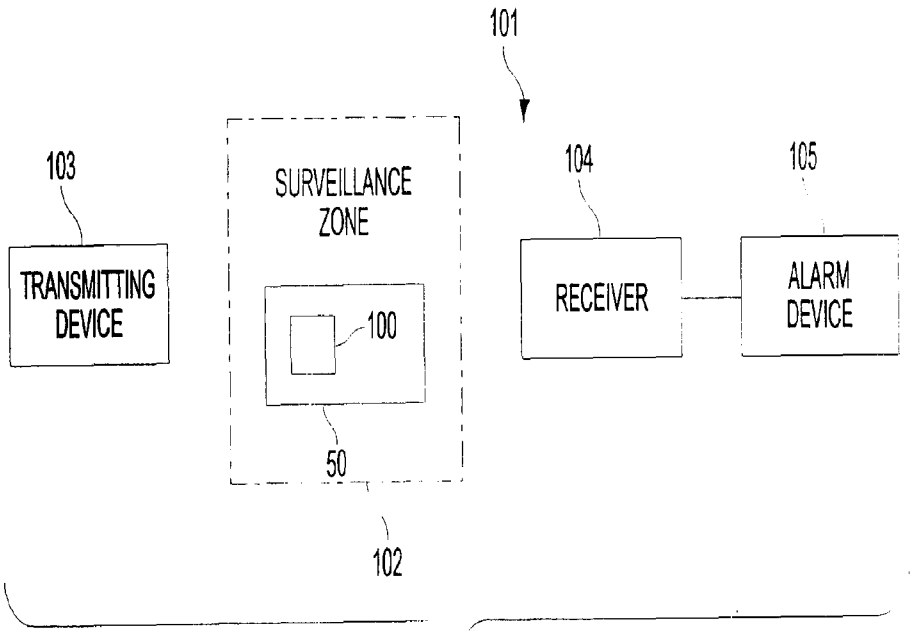

FIG. 8 illustrates an EAS system 101 used to detect or sense EAS tag 100 when passing through a surveillance zone 102. EAS tag 100 represents a tag such as EAS tag 10 or EAS tag 20 as described hereinabove that includes the present invention. An interrogation signal is transmitted into the zone 102 via a transmitting device 103. A signal resulting from interaction of the tag 100 with the transmitted signal is received at a receiver 104, which communicates with a detection and alarm device 105. The latter detects the received signal and generates an alarm indicating the presence of the tag 100 and the article 50 in the surveillance zone 102. The particular configurations used for the devices 103, 104 and 105 in the system 101 will depend on the specific installation. For example, instead of a transmitter 103 and separate receiver 104, one or more transceivers can be used.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A deactivatable magnetomechanical electronic article surveillance marker, comprising:

a magnetostrictive resonator adapted to mechanically resonate at a frequency within a preselected detection frequency range provided by an incident magnetic field;

a magnetizable bias magnet disposed adjacent said resonator that, when magnetized, biases said resonator with a magnetic field having a predetermined field strength to arm said resonator to resonate at said frequency, said bias magnet being magnetostrictive and demagnetizable by stress, wherein normal use of an article incorporating the marker deactivates the marker.

2. The marker of claim 1 wherein the marker is incorporated into the article during manufacturing of the article.

3. The marker of claim 1 wherein the marker is attached to the article after manufacturing of the article.

4. The marker of claim 1 wherein said bias magnet is made of an alloy composition comprising a saturation magnetostriction of about 25 to about 50 ppm.

5. The marker of claim 4 wherein said bias magnet is made of an alloy composition comprising a saturation magnetostriction of about 50 ppm.

6. The marker of claim 5 wherein said stress results in a reduction in bias magnetic flux level from about 100% of a maximum magnetic value to about 30% of the maximum magentic value.

7. The marker of claim 6 wherein said stress is at least 100 bending cycles of a maximum of about 1 inch bend diameter of said bias magnet.

8. A deactivatable magnetomechanical electronic article surveillance marker, comprising:

a marker housing attachable to an article;

a magnetostrictive resonator adapted to mechanically resonate at a frequency within a preselected detection frequency range provided by an incident magnetic field, said resonator disposed within said marker housing;

a magnetizable bias magnet disposed adjacent said resonator that, when magnetized, biases said resonator with a magnetic field having a predetermined field strength to arm said resonator to resonate at said frequency;

means disposed adjacent said marker housing for compressing said marker housing during ordinary usage of the article to dampen said mechanical resonance of said magnetostrictive resonator, therein deactivating the marker.

9. The marker of claim 8 wherein said means for compressing said marker housing is a mechanical deactivator attachable to said marker housing and having a moveable member with a free end terminating in a pointed protrusion, said moveable member adapted to move towards said marker housing forcing said pointed protrusion into said marker housing during ordinary usage of the article to dampen said mechanical resonance of said magnetostrictive resonator.

10. The marker of claim 8 wherein said bias magnet being magnetostrictive and demagnetizable by stress, wherein normal use of the article incorporating the marker demagnetizes the bias magnet and deactivates the marker.

11. An electronic article surveillance system, comprising:

an electronic article surveillance tag attachable to an article, said electronic article surveillance tag including:

a magnetostrictive resonator within said tag adapted to mechanically resonate at a frequency within a preselected detection frequency range provided by an incident magnetic field;

a magnetizable bias magnet disposed adjacent said resonator that, when magnetized, biases said resonator with a magnetic field having a predetermined field strength to arm said resonator to resonate at said frequency, said bias magnet being magnetostrictive and demagnetizable by stress, wherein normal use of an article incorporating the marker deactivates the marker;

means for transmitting a first signal comprising said incident magnetic field, into a surveillance zone; and means for receiving a tag signal including said frequency resulting from the interaction in said surveillance zone of said first signal with said resonator in said tag for detecting the presence of said tag in said surveillance zone.

12. An electronic article surveillance system, comprising:

an electronic article surveillance tag attachable to an article, said electronic article surveillance tag including:

a marker housing;

a magnetostrictive resonator adapted to mechanically resonate at a frequency within a preselected detection frequency range provided by an incident magnetic field, said resonator disposed within said marker housing;

a magnetizable bias magnet disposed adjacent said resonator that, when magnetized, biases said resonator with a magnetic field having a predetermined field strength to arm said resonator to resonate at said frequency;

means disposed adjacent said marker housing for compressing said marker housing during ordinary usage of the article to dampen said mechanical resonance of said magnetostrictive resonator;

means for transmitting a first signal comprising said incident magnetic field, into a surveillance zone; and means for receiving a tag signal including said frequency resulting from the interaction in said surveillance zone of said first signal with said resonator in said tag for detecting the presence of said tag in said surveillance zone.

* * * * *

UNITED STATES PATENT AND TRADEMARK OFFICE

CERTIFICATE OF CORRECTION

PATENT NO. : 6,489,891 B1
DATED : December 3, 2002
INVENTOR(S) : Wing Ho et al.

It is certified that error appears in the above-identified patent and that said Letters Patent is hereby corrected as shown below:

The title page should be deleted and substitute therefore the attached title page.

Drawings,
Delete Drawing Sheets 1-8, and substitute therefore the Drawing Sheets, consisting of Figs. 1-8, as shown on the attached pages.

Signed and Sealed this

Third Day of June, 2003

JAMES E. ROGAN
*Director of the United States Patent and Trademark Office*

(12) United States Patent
Ho et al.

(10) Patent No.: US 6,489,891 B1
(45) Date of Patent: Dec. 3, 2002

(54) APPARATUS FOR ELECTRONIC ARTICLE SURVEILLANCE TAG POLLUTION REDUCTION

(75) Inventors: Wing Ho, Boynton Beach, FL (US); Eugenio Morgado, Boca Raton, FL (US); Larry Speciale, Loxahatchee, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/859,186

(22) Filed: May 16, 2001

(51) Int. Cl.[7] ..... G08B 13/14
(52) U.S. Cl. ..... 340/572.3; 340/572.6
(58) Field of Search ..... 340/572.3, 572.1, 340/572.6, 572.8, 572.9

(56) References Cited

U.S. PATENT DOCUMENTS 4,510,489 A 4/1985 Anderson et al. ..... 340/572.1
4,797,658 A * 1/1989 Humphrey ..... 340/551
5,012,225 A 4/1991 Gill ..... 340/572.3
5,574,431 A 11/1996 McKeown et al. ..... 340/572.3
5,689,263 A * 11/1997 Dames ..... 342/51
5,729,200 A 3/1998 Copeland et al. ..... 340/551
6,091,607 A * 7/2000 McKeown et al. ..... 361/777

* cited by examiner

*Primary Examiner*—Benjamin C. Lee
(74) *Attorney, Agent, or Firm*—Rick F. Comoglio

(57) ABSTRACT

A magnetomechanical EAS tag having a bias magnet made of a high magnetostrictive material so that stress, which is a result of ordinary use of an article incorporating the tag, demagnetizes the bias rending the EAS tag inactive is provided. In an alternate embodiment a mechanical mechanism is incorporated with a conventional EAS tag to deactivate the tag upon ordinary use of an article to which the tag is associated. In yet another embodiment, a combination of the bias magnet made of a high magnetostrictive material and a mechanical deactivation mechanism is used to deactivate an EAS tag during ordinary use of an article to which the tag is associated.

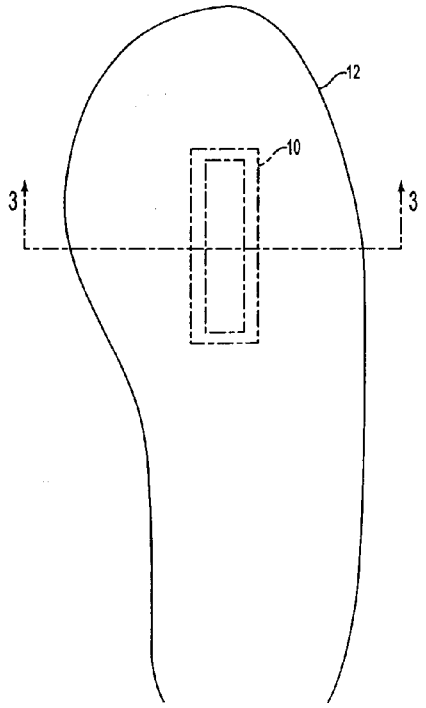

12 Claims, 6 Drawing Sheets